United States Patent [19]

Beerens et al.

[11] 4,231,553

[45] Nov. 4, 1980

[54] APPARATUS FOR COOLING RAPIDLY MOVING ROLLED MATERIAL

[75] Inventors: Hugo Beerens, Meerbusch; Hugo Feldmann, Alsdorf-Warden; Claus G. Schlanzke, Ratingen-Eckamp, all of Fed. Rep. of Germany

[73] Assignee: Schloemann-Siemag Aktiengesellschaft, Dusseldorf, Fed. Rep. of Germany

[21] Appl. No.: 20,215

[22] Filed: Mar. 13, 1979

Related U.S. Application Data

[63] Continuation of Ser. No. 891,005, Mar. 28, 1978, abandoned.

[30] Foreign Application Priority Data

Mar. 30, 1977 [DE] Fed. Rep. of Germany ..... 2714019

[51] Int. Cl.[3] ..... C21D 9/52

[52] U.S. Cl. ..... 266/113; 148/156

[58] Field of Search ..... 148/12 B, 143, 153, 148/156, 157; 266/111, 113, 106, 259; 432/77, 85

[56] References Cited

U.S. PATENT DOCUMENTS

| | | | |
|---|---|---|---|
| 1,211,277 | 1/1917 | Bloom | 266/113 |
| 2,658,012 | 11/1953 | Strachan | 148/156 |
| 2,756,169 | 7/1956 | Corson et al. | 148/12.4 |
| 2,994,328 | 8/1961 | Lewis | 266/113 |
| 3,011,928 | 12/1961 | Kopec et al. | 148/156 |
| 3,208,742 | 9/1965 | Peretick | 148/143 |
| 3,675,908 | 7/1972 | Amend | 148/143 |
| 3,861,597 | 1/1975 | Tsukamura et al. | 266/113 |
| 3,904,444 | 9/1975 | Grange | 148/12 B |
| 3,945,623 | 3/1976 | Gaudilliere et al. | 148/157 |
| 3,997,376 | 12/1976 | Hemsath et al. | 148/143 |

*Primary Examiner*—R. Dean
*Assistant Examiner*—Peter K. Skiff
*Attorney, Agent, or Firm*—Holman & Stern

[57] ABSTRACT

Rolled material leaving a rolling mill is cooled by passing it through a series of guide tubes. A pre-mixed mixture of air and water is injected into each of the tubes by nozzles facing in the direction in which the wire passes, and the wire is cooled by the mixture. The water can be removed at the downstream end of the apparatus by a nozzle facing in the opposite direction to that in which the wire travels.

5 Claims, 5 Drawing Figures

APPARATUS FOR COOLING RAPIDLY MOVING ROLLED MATERIAL

This is a continuation of application Ser. No. 891,005, filed Mar. 28, 1978, now abandoned.

FIELD OF THE INVENTION

The invention relates to an apparatus for cooling rolled material which runs at high speed through guide tubes by introducing water into the guide tubes, carrying out the method.

BACKGROUND OF THE INVENTION

Apparatuses of this kind, which are referred to as water cooling sections, serve the purpose of cooling wire, which issues from the last rolling frame of a wire rolling mill prior to entry into a coiler, to lower the temperature as quickly as possible to the temperature required for the heat treatment of the wire. However, this cooling should not take place too abruptly, as otherwise the temperature difference between the wire core and the surface of the wire will become too great. The altered transformation conditions may then cause inhomogeneities in structure over the wire cross-section. Finally, the temperature should not fall below a safety temperature of about 500° C., as otherwise there would be a risk of martensite formation.

A drawback of guide tubes, through which water flows, which has already been recognised is that the tip of the wire, on being introduced, is braked by pressure build-up of the water present in the guide tube. Because the wire tip bends (which is not possible to avoid) an additional component of movement is directed towards the tube wall, and this results in a high degree of friction. In this way the wire frequently breaks out of conventional water cooling sections. To avoid this disadvantage, it is known to release the inflow of water into the guide tubes only after the wire tips have been introduced. At the high wire speeds usual at the present time this procedure means that the first 50 to 100 meters of each coil are cooled in an uncontrolled manner and have to be rejected due to their non-uniform structure and their thick scale layer.

It is further known, for reducing the build-up of pressure when the wire is introduced, to produce a water-/air mixture in the water filled guide tubes by blowing air into the latter. However, a uniform cooling effect is not ensured by this method owing to the inadequate mixing of the air and water in the guide tubes.

SUMMARY OF THE INVENTION

The aim of the invention is to provide an apparatus for cooling rolled material, which runs through guide tubes at high speed, in which the braking of the rolled material by the cooling water within the tubes is largely prevented. A further aim is to ensure uniform cooling and, uniform structure, along the whole length of the wire.

The invention also has the object of providing a simple and robust cooling apparatus, in which it will be possible to achieve a cooling effect which can be controlled precisely over a wide range of operating conditions while at the same time keeping the operating costs low.

According to the invention the objects are achieved by mixing the cooling water with air prior to introducing it into the guide tubes. When the wire tip is introduced into the tubes the compressible air/water mixture presents an appreciably lower pressure build-up than is the case when only water is used, so that disturbances, in the form of bending or breakout of the wire, are precluded. Surprisingly, it has been found that there has been no appreciable reduction in the cooling effect as compared with cooling effected with water alone. The formation of a water/air mixture prior to introduction into the cooling tubes enables the composition of the mixture to be controlled as desired.

In a proposed apparatus for carrying out this method the outlet opening of an infeed duct for a water/air mixture is directed at an acute angle into an opening of each cooling tube, the cooling tubes being spaced from one another. As each cooling tube is individually supplied with the water/air mixture a uniform cooling effect is achieved along the whole cooling section. The infeed ducts are preferably directed onto the wire inlet end of the guide tubes. The water may be separated from the wire at the end of the cooling section by directing an outlet opening of one or two of these ducts at an acute angle onto the wire outlet opening of one of the last guide tubes.

A water/air mixture can be simply obtained by providing the water infeed duct with a constriction, in the vicinity of which there is provided a free air inlet opening. Using this principle of the water jet pump it is possible to dispense with the necessity of providing special compressed air feed ducts and means for controlling the latter.

Each air inlet opening may be provided with a throttle-type valve for altering the mixing ratio.

Further objects and advantages of the invention will become apparent from the following description, which is given by way of example, read in conjunction with the accompanying drawings.

Figure 3:
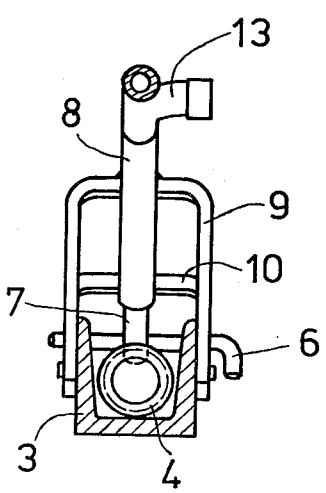
FIG. 3 is a cross-section taken along line II—II.
Figure 5:
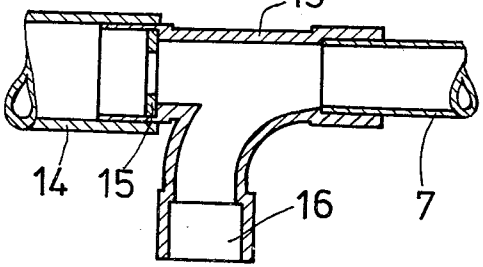
FIG. 5 is a cross-section of a mixing unit.
Figure 4:
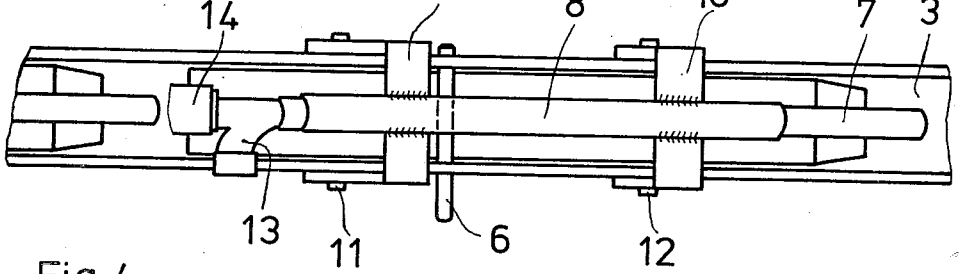
FIG. 4 is a plan view of the subject matter of FIG. 3.

A trough 3 is fixed on a support 2, which is arranged between two protective side walls 1, and a number of guide tubes 4 are arranged, one in front of the other in the trough, the spacing between adjacent tubes 4 being small. Guide tubes 4 are provided with an outer groove 5, and pins 6, which are guided in bores formed in the side cheeks of the trough engage in the grooves (FIGS. 2, 3, and 4). Thus, the guide tubes 4 can rotate about their own axes but are fixed in their longitudinal direction. The direction in which the wire runs into the tubes is indicated by an arrow in FIG. 1.

The openings of cooling medium inlet ducts or tubes 7 are directed at an acute angle into the conically widened wire inlet openings of the guide tubes 4. The tubes 7 are held in sleeves 8 which are fixed by means of lateral straps 9, 10 and bolts 11, 12 to the trough. Each tube 7 is connected to a T-shaped mixing unit 13, which is coaxially connected to an infeed tube 14 for pressurised water. The through flow cross-section of the mixing unit 13 is restricted, at the end connected to the infeed tube 14 (for water under pressure) by a disc 15, which has a small internal cross-section. This constriction in the through flow cross-section causes a vacuum, in the area downstream of the disc 15, when water is introduced. An outwardly open tubular connection 16 opens into this area, air being sucked through this tubular connection piece 16 into the water stream. The water/air mixture thus formed can be controlled, in respect of the mixing ratio, by a throttle-type valve (not shown) in the tube 16.

Figure 1:
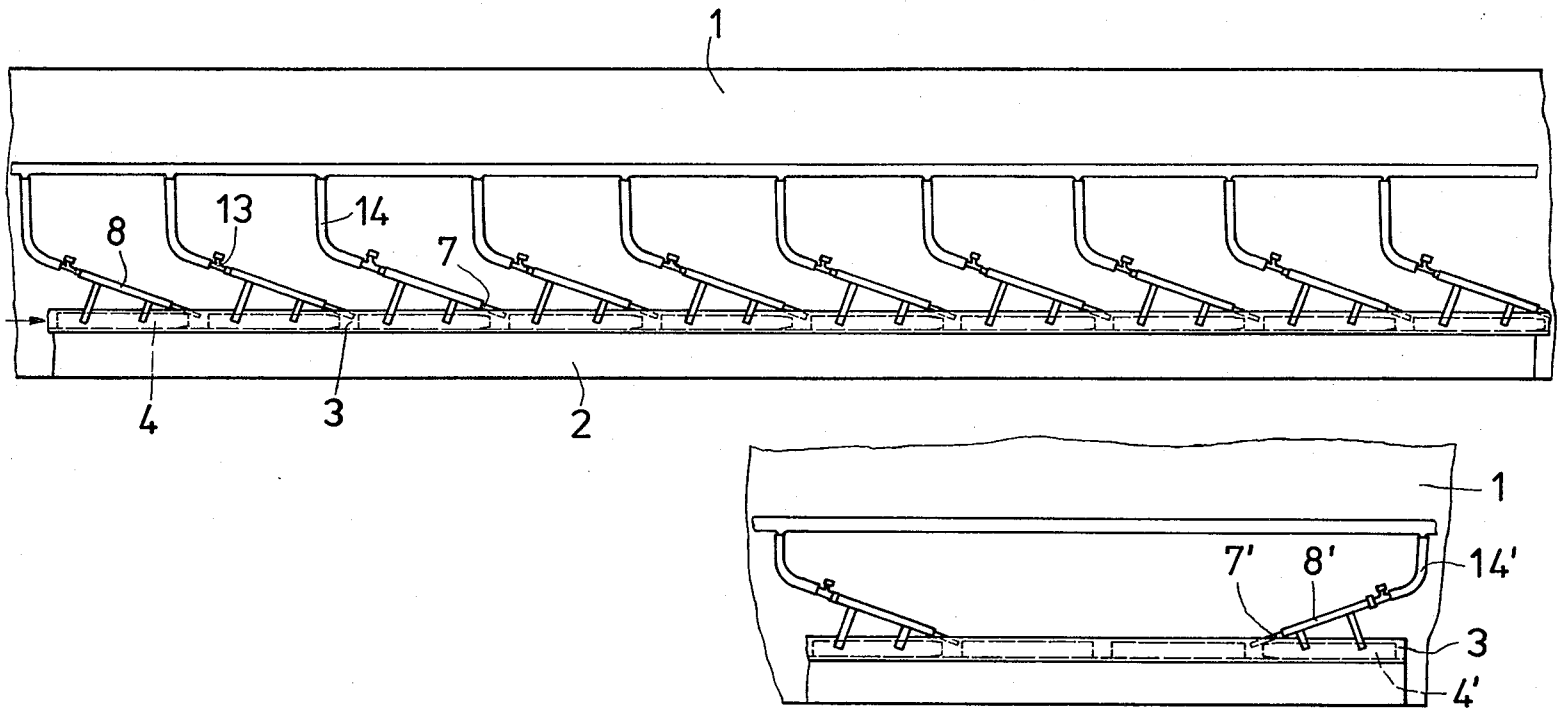
FIG. 1 is a side elevation of a cooling apparatus according to the invention.
Figure 2:
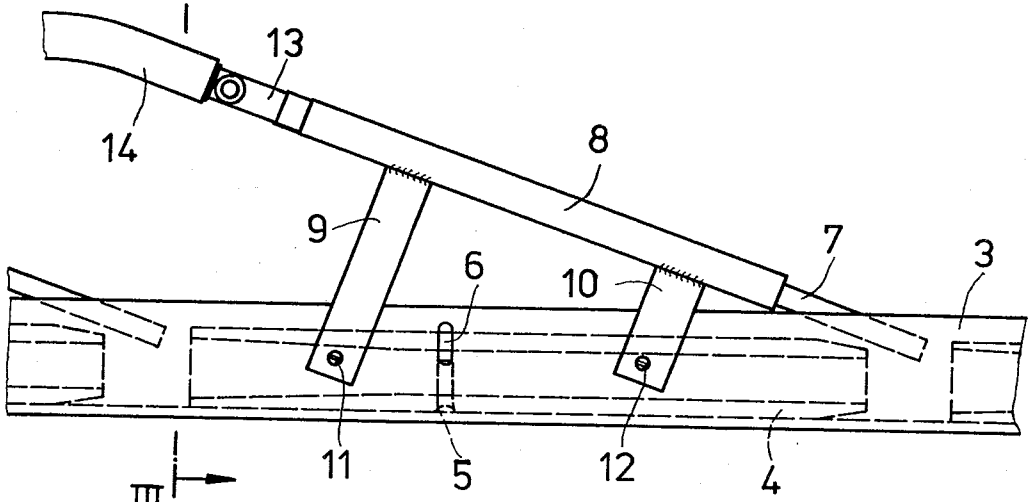
FIG. 2 shows part of the apparatus on an enlarged scale.

The end part of the cooling section is shown in the lower part of FIG. 1. A tube 7' lying within a sleeve 8' is directed at an acute angle into the wire outlet side of the penultimate guide tube 4. In this way the water is separated from the wire in this end portion of the cooling section, so that large quantities of water cannot issue from the last guide tube 4'.

We claim:

1. Apparatus for cooling hot, rolled material issuing from the rolling mill at high speed, the apparatus having an upstream end and a downstream end, the apparatus comprising a plurality of guide tubes arranged in line and spaced from one another, the tubes having entry ends for admitting the rolled material and exit ends, the tubes defining a path for rolled material through the apparatus, mixing means external to said guide tubes for forming a water/air mixture, and a plurality of cooling medium supply pipes directed into the ends of respective tubes at an acute angle to the path of the rolled material through the apparatus to introduce the water/air mixture into the tubes.

2. Apparatus as claimed in claim 1, wherein the cooling medium supply pipes are directed into the rolled material entry ends of the guide tubes.

3. Apparatus as claimed in claim 2, wherein at least one supply pipe at the downstream end of the apparatus is directed into the exit end of a tube at an acute angle to the path of the rolled material through the tube.

4. Apparatus as claimed in claim 1, wherein each cooling medium supply pipe has a water inlet pipe and an air inlet pipe, and the air inlet pipe joins the water inlet pipe downstream of a constriction in the water pipe.

5. Apparatus as claimed in claim 4, wherein a throttle valve is provided in the air inlet pipe.

* * * * *